US008869947B2

(12) United States Patent
Härkönen

(10) Patent No.: US 8,869,947 B2
(45) Date of Patent: Oct. 28, 2014

(54) METHOD AND SYSTEM FOR PRESENTING INFORMATION IN AN ELEVATOR CAR BASED ON SPEED

(71) Applicant: KONE Corporation, Helsinki (FI)

(72) Inventor: Ari Härkönen, Riihimäki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/890,514

(22) Filed: May 9, 2013

(65) Prior Publication Data

US 2013/0248301 A1 Sep. 26, 2013

Related U.S. Application Data

(63) Continuation of application No. PCT/FI2011/050981, filed on Nov. 7, 2011.

(30) Foreign Application Priority Data

Nov. 22, 2010 (FI) ..... 20106228

(51) Int. Cl.
*B66B 1/34* (2006.01)
*B66B 3/00* (2006.01)
*G09F 21/00* (2006.01)

(52) U.S. Cl.
CPC ..... *B66B 3/008* (2013.01); *G09F 21/00* (2013.01)
USPC ..... 187/391; 187/295

(58) Field of Classification Search
USPC ..... 187/277, 391–393, 395, 396, 414; 315/76, 77, 291; 362/146, 147, 276, 362/481
See application file for complete search history.

(56) References Cited

U.S. PATENT DOCUMENTS

| | | | | |
|---|---|---|---|---|
| 3,110,879 | A * | 11/1963 | Nikazy | 187/398 |
| 5,042,620 | A * | 8/1991 | Yoneda et al. | 187/382 |
| 5,485,897 | A * | 1/1996 | Matsumoto et al. | 187/399 |
| 5,606,154 | A * | 2/1997 | Doigan et al. | 187/396 |
| 5,844,181 | A * | 12/1998 | Amo et al. | 187/396 |
| 6,076,638 | A | 6/2000 | Gertz | |
| 6,341,668 | B1 * | 1/2002 | Fayette et al. | 187/391 |
| 6,578,675 | B2 * | 6/2003 | Wilson et al. | 187/391 |
| 6,615,175 | B1 * | 9/2003 | Gazdzinski | 704/275 |

(Continued)

FOREIGN PATENT DOCUMENTS

| | | |
|---|---|---|
| EP | 1864933 A1 | 12/2007 |
| JP | 7-252029 A | 10/1995 |

(Continued)

OTHER PUBLICATIONS

Translation JP19940044087 and JP 19960149192.*

*Primary Examiner* — Anthony Salata
(74) *Attorney, Agent, or Firm* — Birch, Stewart, Kolasch & Birch, LLP

(57) ABSTRACT

The invention relates to an elevator system and also to a method for presenting information during a run with an elevator. In the method, the interior lighting of an elevator car is dimmed during a run sequence of the elevator car, and also information is presented inside on an illuminated display in the elevator car when the interior lighting of the elevator car has been dimmed.

12 Claims, 2 Drawing Sheets

(56) References Cited

U.S. PATENT DOCUMENTS

| | | | | |
|---|---|---|---|---|
| 7,000,735 | B2 * | 2/2006 | Meyer | 187/391 |
| 8,297,791 | B2 * | 10/2012 | Kuang et al. | 362/249.02 |
| 8,373,345 | B2 * | 2/2013 | Mattila et al. | 315/77 |
| 8,528,701 | B2 * | 9/2013 | Schwarzentruber | 187/384 |
| 2004/0188182 | A1 * | 9/2004 | Walters et al. | 187/247 |

FOREIGN PATENT DOCUMENTS

| | | | |
|---|---|---|---|
| JP | 9-328264 | A | 12/1997 |
| WO | WO 98/40816 | A1 | 9/1998 |
| WO | WO 99/36341 | A1 | 7/1999 |
| WO | WO 2008/135627 | A1 | 11/2008 |

* cited by examiner

METHOD AND SYSTEM FOR PRESENTING INFORMATION IN AN ELEVATOR CAR BASED ON SPEED

CROSS REFERENCE TO RELATED APPLICATIONS

This non-provisional application is a Continuation of International Application No. PCT/FI2011/050981 filed on Nov. 7, 2011, which claims the benefit of Finnish Patent Application No. 20106228 filed in Finland on Nov. 22, 2010. The entire contents of all of the above applications are hereby incorporated by reference.

FIELD OF THE INVENTION

The invention relates to solutions for presenting information during a run with an elevator.

BACKGROUND OF THE INVENTION

An elevator system contains different display devices, with which information is displayed. The information presented generally relates to the use of the elevator, such as to information about the stopping floors of an elevator car, the location of an elevator car, et cetera. Developments in display technology have enabled the placement of thinner displays with better picture quality than before e.g. on the stopping floors of an elevator as well as in elevator cars. Owing to improved display technology, it would also be possible to present more diversified and more detailed information in an elevator system.

A new type of display technology for elevators also poses challenges, more particularly relating to the presentation of information. The more precise picture quality of displays is easily left unexploited and the larger amount of details on a display than before might even hamper understanding of the matter being presented if new displays are used simply to replace used displays that are based on simple images, numbers, et cetera, without any additional measures.

AIM OF THE INVENTION

The aim of the invention is to provide a solutionto the problem for detecting and identifying the information to be presented on the display of an elevator car. To achieve this aim the invention discloses a method and also an elevator system as recited in the claims. Some inventive embodiments and inventive combinations of the various embodiments are also presented in the descriptive section and in the drawings of the present application.

SUMMARY OF THE INVENTION

In the method according to the invention for presenting information during a run with an elevator, the interior lighting of an elevator car is dimmed during a run sequence of the elevator car and information is presented inside on an illuminated display in the elevator car when the interior lighting of the elevator car has been dimmed. In a preferred embodiment of the invention the interior lighting of an elevator car is dimmed in the starting phase of a run of the elevator car and the interior lighting of the elevator car is brightened in the ending phase of the run of the elevator car.

In one embodiment of the invention the presentation of information on an illuminated display in an elevator car is started in connection with the dimming of the lighting of the elevator car and the presentation of information on an illuminated display in an elevator car is ended in connection with the brightening of the lighting of the elevator car.

In one embodiment said method is a method for a special run of an elevator. In a preferred embodiment of the invention a run sequence of an elevator car is started on the basis of a destination call. The information given in the destination call is compared to the special floors tabulated about the destination floor, and if the destination floor information corresponds to a special floor, a method for a special run of the elevator is started. Said special run of the elevator is preferably driven directly from the departure floor to the destination floor given in the destination call without stopping at other floors during the run.

In one embodiment of the invention the apparatus is video apparatus in the elevator car, with said illuminated display in the elevator car functioning as the display device of which video apparatus . In this case the film to be shown with the video apparatus is selected on the basis of said destination floor information. In this case the amount of information to be presented can be selected on the basis of the elevator journey e.g. such that when the elevator journey is longer the amount of information is increased.

In one embodiment of the invention the speed of the elevator car is determined and also the interior lighting of the elevator car is dimmed when the speed of the elevator car increases to a preset limit value. In one embodiment of the invention the interior lighting of the elevator car is brightened when the speed of the elevator car decreases to a preset limit value.

The elevator system according to the invention comprises an elevator car, means for controlling a run sequence of the elevator car, means for adjusting the interior lighting of the elevator car, an illuminated display, fitted to the inside of the elevator car, and also a control unit, which is configured to perform any method/function according to what is disclosed above in connection with a run with an elevator.

In a preferred embodiment of the invention the interior lighting of an elevator car comprises a LED light source fitted to the inside of the elevator car, and the means for adjusting the interior lighting of the elevator car are arranged to decrease and also, on the other hand, to increase, the luminous flux of said LED light source during a run sequence of the elevator car.

By means of the invention the visibility of information to be presented on a display of an elevator car can be improved by increasing the luminance contrast of the display in relation to the environment of the display.

Increasing the luminance contrast also increases the attention value of the information to be presented on the display, in which case the attention of elevator passengers can be directed to the display better. This is also an advantage e.g. in a situation when information that is important from the viewpoint of safety, or for other reasons, is presented on the display.

The dimming of the lighting during a run sequence of an elevator car also decreases the energy consumption of an elevator.

The preceding summary, as well as the additional features and advantages of the invention presented below, will be better understood by the aid of the following description of some embodiments, said description not limiting the scope of application of the invention.

BRIEF EXPLANATION OF THE FIGURES

In the following, the invention will be described in detail with reference to the attached drawings, wherein.

MORE DETAILED DESCRIPTION OF PREFERRED EMBODIMENTS OF THE INVENTION

Figure 1:
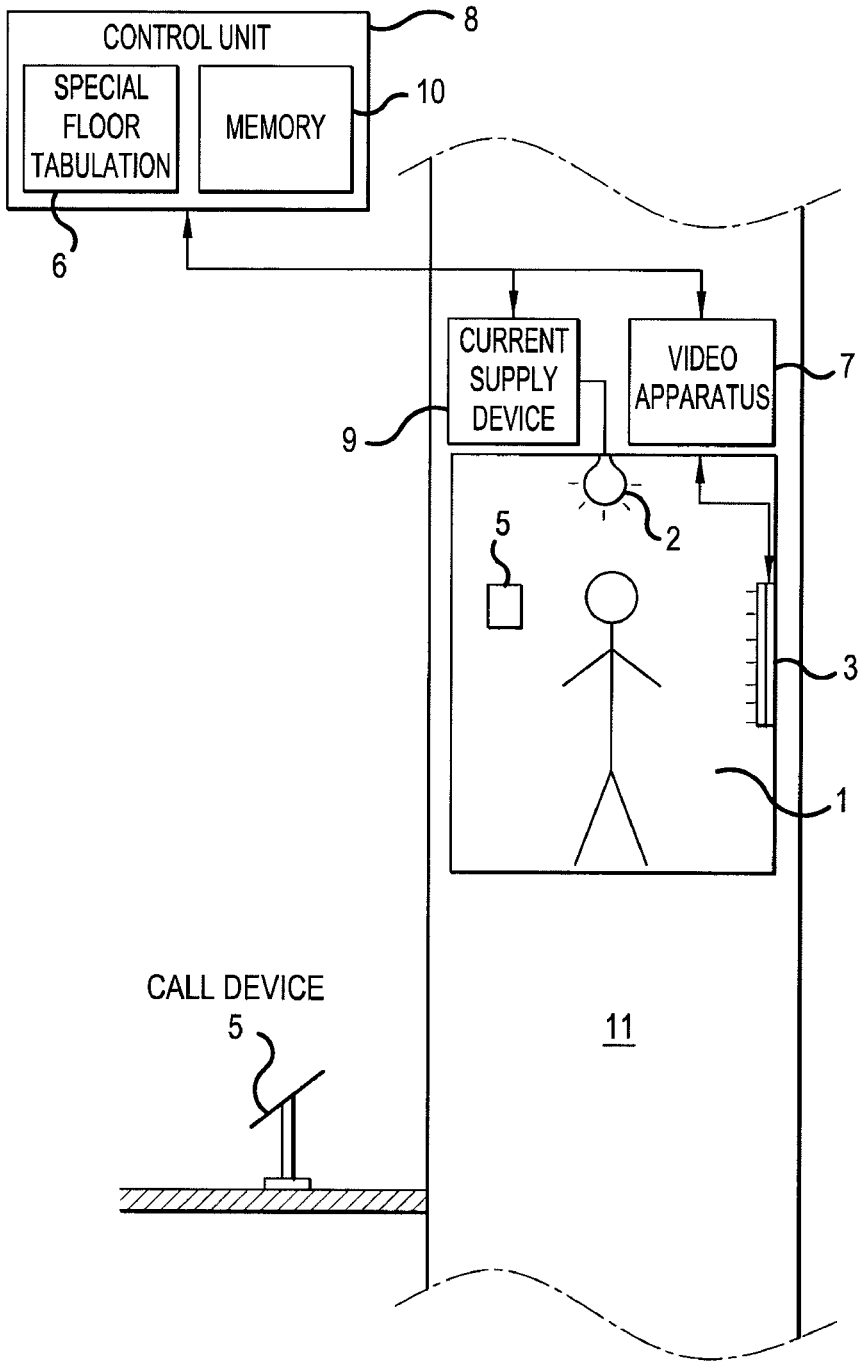
FIG. 1 presents as a block diagram an elevator system according to the invention

FIG. 1 presents as a block diagram an elevator system, in which the elevator car 1 is suspended in the elevator hoistway 11 with suspension means (not presented in FIG. 1) traveling via the traction sheave of the hoisting machine of the elevator. The elevator car is moved in the elevator hoistway 11 in an essentially vertical direction between stopping floors on the basis of destination calls given by elevator passengers. For this reason there are call-giving devices 5 in the elevator cars 1, and also in special cases on the floor levels on stopping floors, for giving destination calls. With the call-giving panels 5 on floor levels information about from which floor an elevator passenger to be served is to be collected is given, in connection with and at the same time as the destination floor information.

The elevator control unit 8 takes care of the control of the movement of the elevator car 1 in response to destination calls. For this reason the elevator control unit 8 calculates the target value for the speed of the elevator car, i.e. the speed reference, according to which the elevator car is moved in the elevator hoistway. If the elevator system consists of a number of elevators, said elevator control unit 8 can also be a group control unit, which allocates a received elevator call to be served to one of the elevators of the elevator group such that the operation of the elevator group can be optimized towards set operational targets.

In the elevator system of FIG. 1, the elevator system 1 comprises a display 3, which is illuminated either with a separate light source, such as with an LED light source, or the surface forming the image on the display 3 can also be self-illuminating; the OLED elements, for example, forming the image also function in this case as a light source of the display. On the roof of the elevator car 1 is video apparatus 7, which is connected to the display 3 in the elevator car with a data transfer bus such that the video signal formed with the video apparatus can be shown on the display 3 of the elevator car. The video apparatus 7 can also be disposed in a space in the elevator car between the display 3 and the wall of the elevator car 1.

The lighting of the elevator car is implemented with LED luminaires 2. On the roof of the elevator car is a current supply device 9 for the LED luminaires, which current supply device forms from 230-volt network voltage an adjustable DC voltage for the supply voltage of the LED luminaires. The luminous flux of the LED luminaires is increased by increasing the DC voltage of the current supply device 9 and is decreased by decreasing the DC voltage of the current supply device 9.

Figure 2:
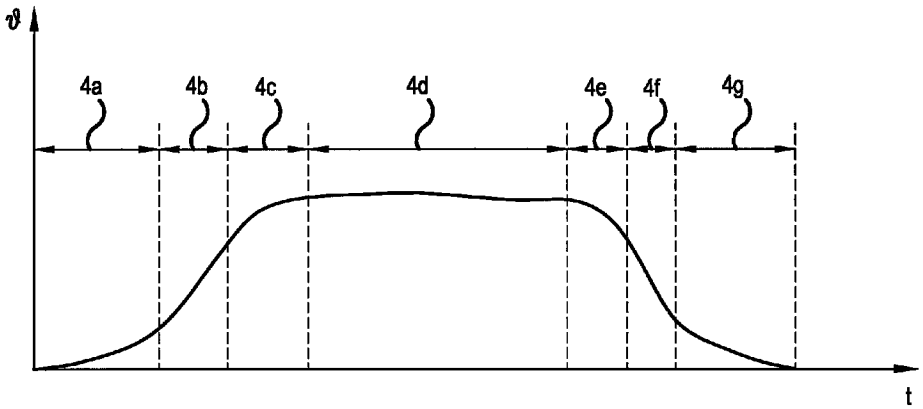
FIG. 2 illustrates a run sequence of the elevator car in one elevator system according to the invention

The video apparatus 7 on the roof of the elevator car and also the current supply device 9 of the LED luminaires are connected to the elevator control unit 8 with a data transfer bus. Software 10 is recorded in the memory of the elevator control unit 8, by executing which software the processor of the elevator control unit 8 controls the lighting 2 of the elevator car and also the video apparatus 7. In the starting phase of a new run sequence the processor of the elevator control unit 8 sends to the current supply device 9 of the LED luminaires a control command for dimming the luminous flux of the LED luminaires and, in the same connection or after a short delay, also to the video apparatus 7 a control command for presenting information on the display 3 of the elevator car. In this case the current supply device 9 of the LED luminaires reduces the DC voltage to be supplied to the LED luminaires to a certain final value for voltage gradually such that the lighting of the elevator car dims evenly. After the lighting has dimmed, information received from the video apparatus 7 is started to be presented on the display of the elevator car, in which case the luminance contrast of the display 3 in the elevator car increases and the attention value and perceivability of the information to be presented improves. FIG. 2 presents in more detail a run sequence of an elevator car e.g. relating to the embodiment of the invention according to FIG. 1. The elevator control unit 8 starts a run sequence after receiving a destination call. In this case in the first phase 4*a* of the run sequence the doors of the elevator car 1 are closed, and after the doors have closed, or slightly before that, the machinery brakes are opened and current is started to be supplied to the elevator motor for supporting/moving the elevator car in the elevator hoistway 11. The speed v of the elevator car is started to be increased according to the speed reference by increasing the acceleration of the elevator car gradually until the acceleration has reached the maximum value desired. After this the run sequence shifts to the phase 4*b* of even acceleration. At the end of the phase of even acceleration and after the speed v of the elevator car has increased, there is a shift to phase 4*c*, in which the acceleration of the elevator car is gradually reduced, until the acceleration goes to zero and the phase 4*d* of even speed starts. During the phase 4*d* of even speed the elevator car is driven at its maximum speed, until it begins to approach the destination floor. In this case the speed v of the elevator car is started to be gradually reduced by increasing the deceleration in phase 4*e*, until the deceleration has increased to the maximum permitted value and there is a shift to the phase 4*f* of even deceleration. When the destination floor approaches and after the speed v of the elevator car has decreased the acceleration is again started to be decreased in the phase 4*g*, until the deceleration goes to zero when the elevator arrives and when it stops at the destination floor. After this, again in the phase 4*g* the machinery brakes of the hoisting machine are activated, the current supply to the elevator motor is disconnected and the doors of the elevator car are opened. In one embodiment of the invention the elevator control unit 8 controls the lighting 2 of the elevator car and also the display 3 such that the dimming of the lighting and the presenting of information on the display 3 of the elevator car as described above are started when the speed/speed reference of the elevator car reaches a preset value in a starting phase 4*a*, 4*b*, 4*c* of a run sequence. Additionally, in an ending phase 4*e*, 4*f*, 4*g* of a run after the speed/speed reference of the elevator car has decreased to a preset value the elevator control unit 8 sends to the current supply device 9 of the LED luminaires 2 a control command, on the basis of which the current supply device 9 increases the luminous flux of the LED luminaires, returning the brightness of the lighting of the elevator car. Further, the elevator control unit 8 sends to the video apparatus 7 a control command, on the basis of which the video apparatus 7 ends the presentation of the information/film on the display 3 of the elevator car.

In one embodiment of the invention special floors 6 are tabulated in the memory of the elevator control unit 8. The processor of the elevator control unit 8 compares the destination call received from a call-giving device 5 to the tabulated special floors, and if the destination floor information corresponds to a special floor 6, the processor starts a special run of the elevator. In this case passengers are transferred from the departure floor to the destination floor according to the destination call by driving the elevator car 1 directly to the destination floor without stopping at other floors in between. In this case the amount of information, such as the length of the film, to be displayed with the video apparatus 7 is selected on the basis of the special floor 6 and also on the basis of the departure floor of the run such that the information/length of film to be displayed is selected on the basis of the length of the elevator journey.

In one embodiment the elevator control unit 8 sends said control command for dimming the luminous flux of the LED luminaires at the same time as the doors of the elevator car start to be closed after the giving of a destination call. The video apparatus 7 is started when the speed of the elevator car 1 has reached a set value. In the ending phase of a run in connection with the deceleration phase the elevator control unit 8 sends a brightening command for the lighting when the speed of the elevator car has decreased to below a preset value. In the same connection, the video apparatus is also ended and the presentation of information ceases.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A method for presenting information during a run sequence of an elevator, the method comprising:

starting the run sequence in response to a destination call, the run sequence comprising a beginning phase of increased acceleration, a middle phase of constant acceleration, and an ending phase of decreased acceleration;

dimming interior lighting of an elevator car and presenting information on an illuminated display in the elevator car, when the speed of the elevator car reaches a predetermined value during the beginning phase of the run sequence of the elevator car.

2. The method according to claim 1, further comprising:

brightening the interior lighting of the elevator car during the ending phase of the run sequence of the elevator car.

3. The method according to claim 2, further comprising:

ending the presentation of information on the illuminated display in an elevator car in connection with the brightening of the lighting of the elevator car.

4. The method according to claim 1, where the destination call is for a special run of the elevator.

5. The method according to claim 1, further comprising:

comparing information given in the destination call to the special floors tabulated about the destination floor; and if the destination floor information corresponds to a special floor, starting a method for a special run of the elevator.

6. The method according to claim 4, wherein a special run of the elevator includes driving the elevator car from the departure floor directly to the destination floor.

7. The method according to claim 4, wherein, the information presented on the illuminated display is a film from a video apparatus selected on the basis of the destination floor data.

8. The method according to claim 1, further comprising:

brightening the interior lighting of the elevator car when the speed of the elevator car decreases to a preset limit value.

9. An elevator system, comprising:

an elevator car;

means for controlling a run sequence of an elevator car;

means for adjusting the interior lighting of an elevator car;

an illuminable display positioned on the inside of the elevator car; and a control unit, configured to perform a method according to claim 1 for presenting information during a run with an elevator.

10. The elevator system according to claim 9, wherein the interior lighting of the elevator car comprises a LED light source.

11. The elevator system according to claim 10, wherein the means for adjusting the interior lighting of an elevator car is configured to decrease the luminous flux of said LED light source during a run sequence of the elevator car.

12. The elevator system according to claim 10 or 11, wherein the means for adjusting the interior lighting of an elevator car is configured to increase the luminous flux of said LED light source during a run sequence of the elevator car.

* * * * *